US011014737B2

(12) United States Patent
Rondelli

(10) Patent No.: US 11,014,737 B2
(45) Date of Patent: May 25, 2021

(54) CAPSULES FOR INFUSION PRODUCTS

(71) Applicant: MACCHIAVELLI S.r.l., San Lazzaro di Savena (IT)

(72) Inventor: Raffaele Rondelli, Argelato (IT)

(73) Assignee: Macchiavelli S.R.L., San Lazzaro di Savena (IT)

( * ) Notice: Subject to any disclaimer, the term of this patent is extended or adjusted under 35 U.S.C. 154(b) by 316 days.

(21) Appl. No.: 16/087,665

(22) PCT Filed: Mar. 23, 2017

(86) PCT No.: PCT/IB2017/051693
§ 371 (c)(1),
(2) Date: Sep. 24, 2018

(87) PCT Pub. No.: WO2017/163210
PCT Pub. Date: Sep. 28, 2017

(65) Prior Publication Data

US 2019/0100376 A1 Apr. 4, 2019

(30) Foreign Application Priority Data

Mar. 23, 2016 (IT) ..... 102016000030458

(51) Int. Cl.
*B65D 85/804* (2006.01)
*A47J 31/40* (2006.01)
*A47J 31/44* (2006.01)

(52) U.S. Cl.
CPC ..... *B65D 85/8043* (2013.01)

(58) Field of Classification Search
CPC ..... B65D 85/8043; A47J 31/407
(Continued)

(56) References Cited

U.S. PATENT DOCUMENTS 2,778,739 A * 1/1957 Rodth ..... A47J 31/0673 426/77
2,968,560 A * 1/1961 Nathan ..... A47J 31/3628 99/295

(Continued)

FOREIGN PATENT DOCUMENTS

WO 2005018395 A1 3/2005
WO 2006021405 A2 3/2006

(Continued)

*Primary Examiner* — Robert J Utama
*Assistant Examiner* — Lawrence H Samuels
(74) *Attorney, Agent, or Firm* — Thomas|Horstemeyer LLP

(57) ABSTRACT

Capsules are provided which include a cup-shaped body and a lid which closes the cup-shaped body superiorly. The cup-shaped body includes a side wall and a bottom wall. The bottom wall has at least one outlet opening for the beverage to flow out of the capsule. The cup-shaped body also includes a retaining wall defining inferiorly an intermediate compartment containing the infusion product. The retaining wall includes an impermeable layer and is spaced from the bottom wall so as to define with the latter a lower compartment. The impermeable layer is configured to autonomously tear, due to the pressure reached in the intermediate compartment following the introduction of pressurized hot water into the capsule. Because tearing of the impermeable layer can take place without interaction with perforating elements, the filter element does not tear, and is therefore able to fully perform its filtering action for the entire duration of the preparation process of the beverage.

15 Claims, 4 Drawing Sheets

(58) Field of Classification Search
USPC ..... 99/295, 323
See application file for complete search history.

(56) References Cited

U.S. PATENT DOCUMENTS 4,077,551 A * 3/1978 Manaresi ..... B65D 85/8043 206/221
4,136,202 A * 1/1979 Favre ..... B65D 85/8043 426/77
5,242,702 A * 9/1993 Fond ..... A47J 31/0673 426/433
5,243,164 A * 9/1993 Erickson ..... A47J 31/02 219/689
5,343,799 A * 9/1994 Fond ..... A47J 31/369 99/295
5,472,719 A * 12/1995 Favre ..... A47J 31/0673 426/112
5,656,316 A * 8/1997 Fond ..... A47J 31/3695 426/433
7,685,930 B2 * 3/2010 Mandralis ..... B65D 85/8043 99/295
7,930,972 B2 * 4/2011 Denisart ..... A47J 31/3695 99/295
2003/0226449 A1 * 12/2003 Carasso ..... A47J 31/0615 99/279
2007/0248734 A1 * 10/2007 Denisart ..... A47J 31/002 426/569
2009/0211458 A1 * 8/2009 Denisart ..... B65D 85/8043 99/300
2009/0235827 A1 * 9/2009 Bongers ..... B65D 85/8043 99/316
2010/0282091 A1 * 11/2010 Doleac ..... B65D 85/8043 99/295
2012/0015080 A1 * 1/2012 Roulin ..... B65D 85/8043 426/110
2013/0216663 A1 * 8/2013 Dogan ..... B65D 85/8043 426/115
2014/0053735 A1 * 2/2014 Verbeek ..... A47J 31/3676 99/295
2014/0366745 A1 * 12/2014 Goglio ..... B65D 85/804 99/295
2015/0232263 A1 * 8/2015 Talon ..... B65D 65/38 426/115
2016/0101929 A1 * 4/2016 Bolzicco ..... B65D 65/466 426/115
2016/0198732 A1 * 7/2016 Charles ..... A23F 5/262 426/115
2016/0353918 A1 * 12/2016 Talon ..... A47J 31/407
2016/0355327 A1 * 12/2016 Minganti ..... B29C 51/082
2017/0029204 A1 * 2/2017 Rondelli ..... B65D 85/8043
2018/0044105 A1 * 2/2018 Tomasi ..... B65D 77/2024
2018/0297776 A1 * 10/2018 Dijkstra ..... A47J 31/407
2019/0016527 A1 * 1/2019 Doglioni Majer ..... B65D 85/8043
2019/0233201 A1 * 8/2019 Kennedy ..... A47J 31/0673

FOREIGN PATENT DOCUMENTS

WO 2012055751 A2 5/2012
WO 2013053655 A1 4/2013
WO 2014037339 A1 3/2014
WO 2014195307 A1 12/2014
WO 2015011689 A1 1/2015
WO WO-2017114970 A1 * 7/2017 ..... B65D 85/8043

* cited by examiner

CAPSULES FOR INFUSION PRODUCTS

CROSS-REFERENCE TO RELATED APPLICATIONS

This application is a National Phase Application of PCT International Application No. PCT/IB2017/051693, International Filing Date, Mar. 23, 2017 claiming priority to Italian Patent Application No. 102016000030458 filed Mar. 23, 2016, each of which is hereby incorporated by reference in its entirety.

FIELD OF THE INVENTION

The present invention relates to capsules for infusion products, in particular coffee, intended to be used in a machine for the extraction of beverages, as described and claimed herein.

Although the invention will hereinafter be illustrated with specific reference to a coffee capsule, it is intended to be applicable in general to a capsule containing any other infusion product.

BACKGROUND OF THE INVENTION

A capsule of the type identified above is known for example from WO 2014/037339. This known capsule comprises a generally frustoconical, cup-shaped body, with a larger base, or lid, through which pressurized hot water is introduced inside the capsule, and with a smaller base, or bottom wall, having an outlet opening through which the beverage flows out of the capsule to be collected in a container, for example a coffee cup. Inside the cup-shaped body a compartment adapted to contain the coffee is provided, which compartment is defined laterally by the cup-shaped body and inferiorly by an impermeable retaining wall. The retaining wall comprises a tearable aluminum membrane which is welded to the cup-shaped body so as to liquid- and air-tightly seal inferiorly the compartment containing the coffee. The retaining wall is spaced from the bottom wall of the capsule and between these walls is arranged a perforation plate adapted to pierce the aluminum membrane when the pressure inside the capsule increases.

To obtain the coffee/water infusion, the capsule is inserted into the percolation chamber of a coffee machine, where a certain amount of pressurized hot water is injected inside the cup-shaped body of the capsule through the lid and thereby mixes with the coffee. The entry of pressurized hot water causes an increase in pressure within the compartment containing the coffee and thus a deformation of the retaining wall towards the perforation plate. As a result of this deformation, the aluminum membrane of the retaining wall comes in contact with the perforating elements, such as points, of the perforation plate, until it tears. Alternatively, the aluminum membrane of the retaining wall may simply tear due to the increased pressure, even before coming into contact with the perforating elements of the perforation plate. The beverage may at this point flow out of the compartment through the passages made in the aluminum membrane as a result of tearing of the same and finally flow out of the capsule through the outlet opening provided in the bottom wall of the cup-shaped body.

SUMMARY OF THE INVENTION

It is an object of the present invention to provide an improved capsule with respect to the prior art discussed above, in particular a capsule which does not require a perforation plate for opening the retaining wall.

This and other objects are fully achieved according to the present invention by capsules having the features described and claimed herein.

In short, the invention is based on the idea of providing a capsule wherein below a retaining wall, which defines inferiorly the compartment containing the infusion product (hereinafter also referred to as "ingredient compartment") and which includes an impermeable layer firmly secured at a peripheral edge thereof to the cup-shaped body, an elastically deformable and perforated support disc is arranged, which disc is configured to flex towards the bottom wall of the capsule starting from an initial undeformed condition, as a result of the flexing of the impermeable layer when the pressure inside the compartment increases upon introduction of pressurized hot water. The support disc is deprived of perforating elements facing the overlying impermeable layer. Preferably, in the initial undeformed condition the support disc is in contact with the retaining wall. Furthermore, in the initial undeformed condition the support disc is arranged with only its peripheral edge resting on the bottom wall of the cup-shaped body of the capsule or on a suitable support surface placed at a distance from the bottom wall. Following the introduction of pressurized hot water inside the capsule, and thus the pressure increase inside the compartment containing the infusion product, the retaining wall deforms towards the bottom wall of the capsule, causing the support disc to also deform. At this stage, the support disc accompanies the deformation of the retaining wall, with the result that the impermeable layer is torn, due to the increased stress state to which it is subjected as a result of its deformation, not at the center but rather in the vicinity of its peripheral edge. This allows to obtain a better outflow of the beverage from the compartment and thus to improve the quality of the beverage produced. Furthermore, the tearing of the impermeable layer takes place without interaction with perforating elements, but rather only as a result of the deformation to which it is subjected as a result of the increased pressure inside the compartment containing the infusion product following the introduction of pressurized hot water inside the capsule.

The impermeable layer is made of a given material and/or has a given thickness, the material and/or the thickness being chosen in such a way as to ensure the tearing of the impermeable layer once a given pressure within the ingredient compartment is reached. The impermeable layer may for example be made of aluminum, with a thickness equal for example to 0.02 mm. Alternatively, or in addition, tearing of the impermeable layer of the retaining wall may be obtained by providing at least one specific tear point in this layer.

According to one embodiment, the support disc has, on its upper face, at least one labyrinth groove ending with a through hole. Alternatively, the support disc may have a plurality of through holes distributed over the entire support disc itself, or at least over a part thereof.

The capsule further comprises filtering elements, which may be arranged above or below the impermeable layer, in contact with, or at a certain distance from, such layer. The filtering elements may for example be arranged between the impermeable layer and the support disc or below the support disc, in contact with, or at a certain distance from, such disc.

In certain embodiments, the filtering elements are formed by a layer of filter paper. The filter paper layer may be arranged below the impermeable layer, for example firmly connected to the support disc, or above the impermeable layer, for example welded to a support surface formed by the cup-shaped body of the capsule.

The support disc may be made of plastic material or any other suitable material, such as for example filter paper.

In one embodiment of the invention, the lid of the capsule is impermeable, being for example formed by an aluminum foil. In this case, the capsule may further comprise an upper wall which defines superiorly the compartment containing the infusion product and is spaced from the lid so as to define with the latter an upper compartment. This upper wall has a plurality of holes and is formed for example by a microperforated film. The pressurized hot water is introduced into the upper compartment by a needle of the machine, after the same has perforated the lid, and from here is distributed in the compartment containing the infusion product, passing through the holes provided in the upper wall.

According to one variant of the invention, the lid of the capsule is permeable and the compartment containing the infusion product is directly closed by the lid, i.e. no upper compartment between the lid and the compartment containing the infusion product is provided. In this case, the pressurized hot water is injected directly into the compartment containing the infusion product through the holes provided in the lid. As in this case the lid is permeable, measures must naturally be taken to prevent the infusion product contained in the capsule from coming into contact with the air. In a per se known manner, the capsule may for example be inserted in a packaging of impermeable material, such as aluminum.

In one embodiment of the invention, the cup-shaped body of the capsule has in its lower area, in addition to the outlet opening, a lateral hole adapted to put the lower compartment of the capsule, i.e. the compartment provided between the retaining wall and the bottom wall, into communication with the external environment in order to maintain the pressure within such compartment equal to the external pressure.

Further features and advantages of the present invention will become more apparent from the following detailed description, given purely by way of non-limiting examples with reference to the attached drawings.

DETAILED DESCRIPTION

Figure 1:
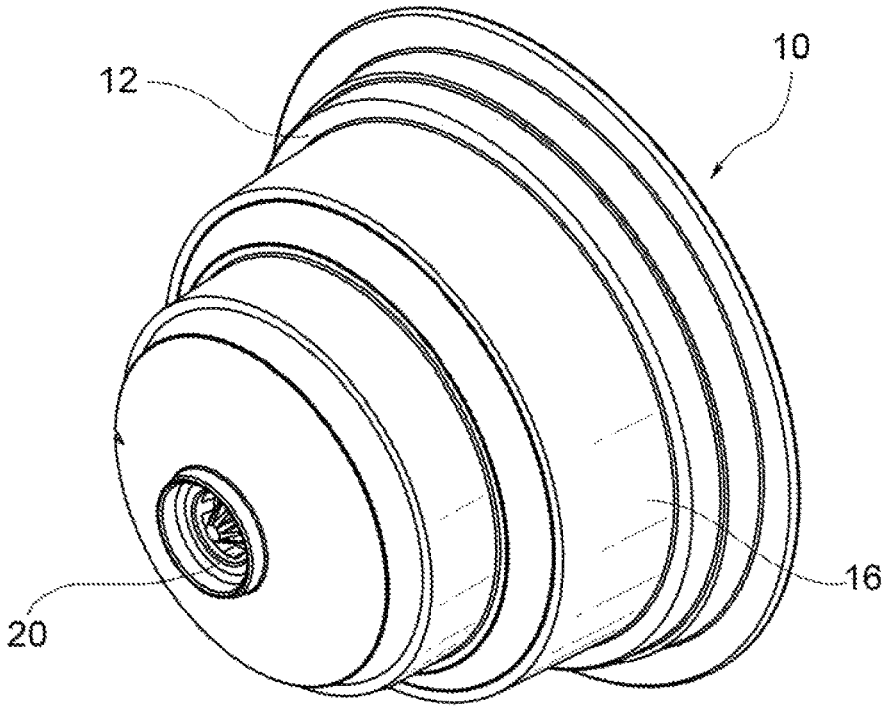
FIG. 1 is an isometric view of a capsule for infusion products according to one embodiment of the present invention.
Figure 2:
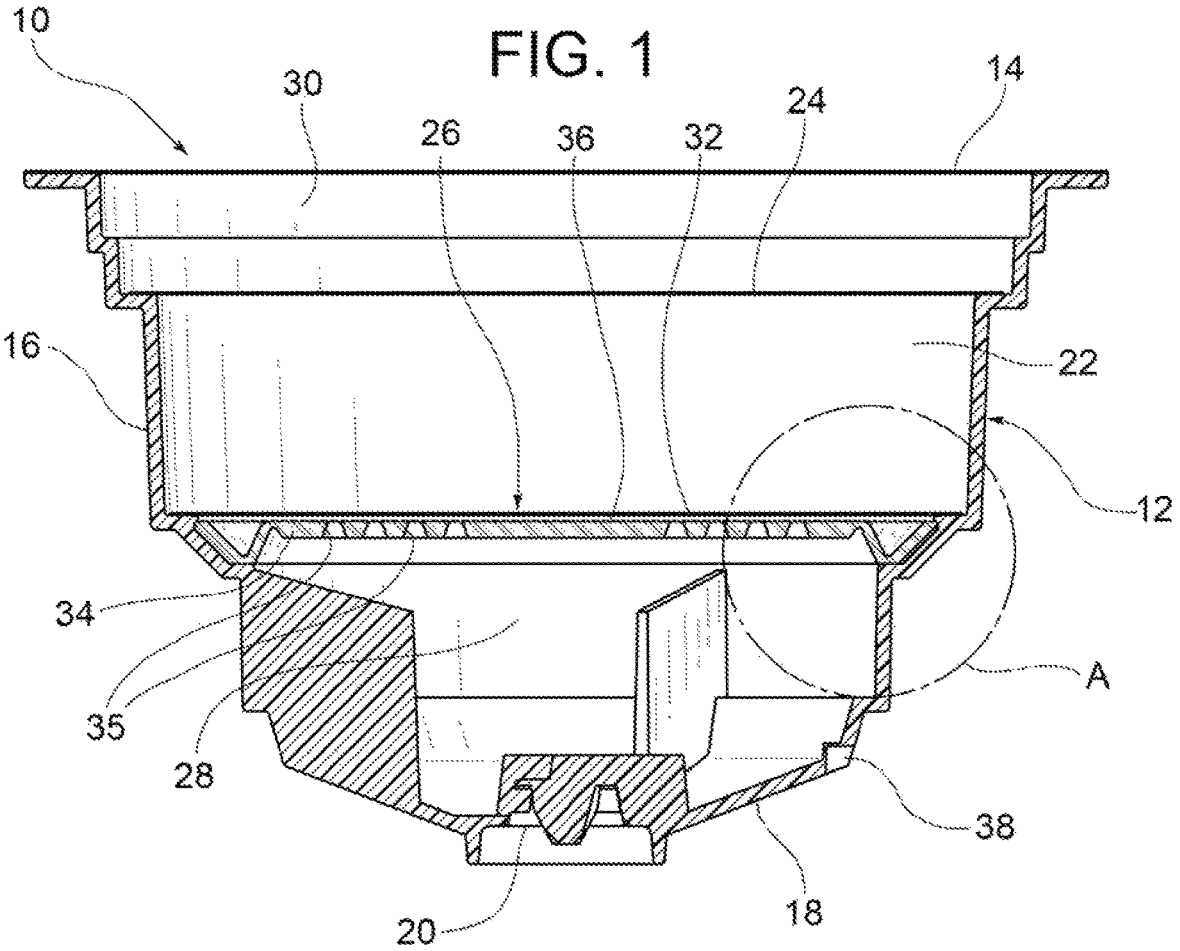
FIG. 2 is an axial sectional view in of the capsule of FIG. 1.

With reference first to FIGS. 1 and 2, a capsule for infusion products, such as for example coffee, according to an embodiment of the present invention is generally indicated 10. The capsule 10 comprises a cup-shaped body 12 and a lid 14 which closes superiorly the cup-shaped body 12. The cup-shaped body 12 comprises a side wall 16 and a bottom wall 18. The bottom wall 18 has at least one outlet opening 20, preferably in the central position, for allowing the beverage to flow out of the capsule. Preferably, the cup-shaped body 12 has a generally frustoconical shape, of which the bottom wall constitutes the smaller base, while the lid constitutes the larger base.

The infusion product (e.g. coffee) is contained in an intermediate compartment, or ingredient compartment, 22 enclosed laterally by the side wall 16 of the cup-shaped body 12, superiorly by a top wall 24 and inferiorly by a lower wall, or retaining wall, 26. The upper wall 24 may not be provided, in which case the ingredient compartment 22 is enclosed superiorly directly by the lid 14. The retaining wall 26 is spaced from the bottom wall 18 of the cup-shaped body 12 so as to define with the latter a lower compartment 28.

In the embodiment herein proposed the lid 14 is impermeable, as it is for example formed by an aluminum foil. Where provided, the upper wall 24 of the intermediate compartment 22 is spaced from the lid 14 so as to define with the latter an upper compartment 30. Furthermore, the upper wall 24 has a plurality of holes, as it is formed for example by a microperforated film, so as to allow a uniform distribution inside the intermediate compartment 22 of the pressurized hot water that is introduced into the upper compartment 30 by a needle of the machine after the needle has pierced the lid 14.

According to a variant of the invention, not shown, the lid is permeable, as it is for example formed by a microperforated film. In this case, the lid directly forms the upper wall of the ingredient compartment, and therefore there is no upper compartment between the lid and the ingredient compartment. The pressurized water is thus injected directly into the ingredient compartment through the holes provided in the lid. As in this case the lid is permeable, measures must naturally be taken to prevent the infusion product contained in the capsule from coming into contact with the air. In per se known manner, the capsule may for example be placed in a packaging of impermeable material, such as aluminum.

Figure 3:
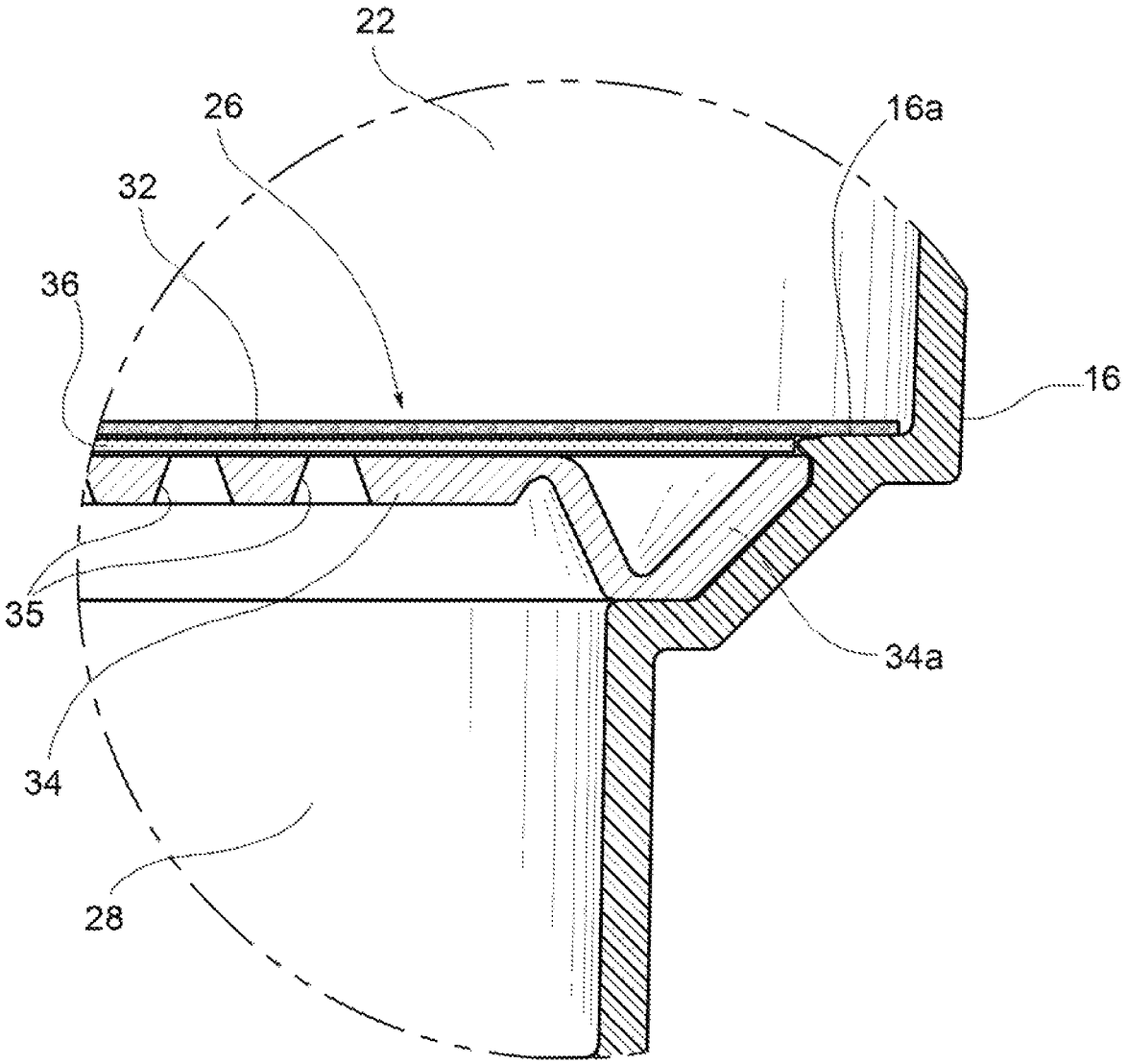
FIG. 3 shows, on an enlarged scale, the detail A of FIG. 2.

With reference also to FIG. 3, the retaining wall 26 includes an impermeable layer 32, which is firmly connected to the side wall 16 of the cup-shaped body 12, for example on a horizontal flat surface 16*a* (FIG. 3) of the side wall 16 acting as a shoulder, so as to liquid- and air-tightly seal inferiorly the ingredient compartment 22. The impermeable layer 32 is configured to tear autonomously, without interaction with perforating elements or like elements of the capsule, as a result of only the pressure reached within the ingredient compartment 22 upon introduction of pressurized hot water. The impermeable layer 32 is made for example of aluminum, with a thickness equal for example to 0.02 mm. Alternatively, the impermeable layer 32 may be made for example of plastic material. To facilitate the tearing of the impermeable layer 32 and/or to cause the tearing in one or more predetermined points, one or more tear points may be provided in this layer.

The capsule 10 further comprises an elastically deformable support disc 34 placed beneath the impermeable layer 32. The support disc 34 is restrained in the cup-shaped body 12, for example by means of interlocking coupling. In particular, the support disc 34 is arranged with only a peripheral edge 34*a* thereof (FIG. 3) resting on a suitable support surface which is formed by the side wall 16 of the cup-shaped body 12 and is placed at a distance from the bottom wall 18, as in the embodiment of FIGS. 1 to 3, or directly on the bottom wall 18. Alternatively, the support disc 34 may be formed in one piece with the cup-shaped body 12. The support disc 34 is configured to flex elastically downwards, i.e. toward the bottom wall 18, as a result of the flexing of the impermeable layer 32, when the pressure inside the ingredient compartment 22 increases as a result of the introduction of pressurized hot water into the capsule, from an initial undeformed condition (shown in FIGS. 2 and 3) to a deformed condition. Moreover, the support disc 34 is perforated to allow the beverage to pass through the disc itself towards the lower compartment 28 and the outlet opening 20 as a result of the tearing of the impermeable layer 32. In this regard, in the embodiment of FIGS. 2 and 3 the support disc 34 has a plurality of holes 35 distributed over part of the support disc itself, but alternatively the holes may also be distributed over the entire support disc. The support disc 34 is also deprived of perforating elements facing towards the overlying impermeable layer 32.

The support disc 34 may be made of plastic material, but may also be made of another suitable material, for example filter paper, so as to deform together with the impermeable layer 32 without, however, tearing as a result of the increased pressure in the ingredient compartment when pressurized hot water is introduced into the capsule 10, and to serve also as a filter element.

The capsule 10 further comprises a filter element 36 configured to filter the beverage before the latter flows out of the capsule through the outlet opening 20, thus preventing the product granules from passing through the retaining wall 22 together with the beverage as a result of the tearing of the impermeable layer 32. The filter element 36 is formed for example by a layer of filter paper. In the embodiment shown in FIGS. 1 to 3, the filter element 36 is arranged above the support disc 34, firmly connected to the latter.

Alternatively, the filter element 36 may be arranged below the support disc 34 (in contact with or at a certain distance from the same) or above the impermeable layer 32.

Preferably, the cup-shaped body 12 has, in its lower area, in addition to the outlet opening 20, a lateral hole 38 (FIG. 2) adapted to put the lower compartment 28 in communication with the external environment in order to keep the pressure in that compartment equal to the external pressure and thus improve the dispensing of the beverage from the capsule.

Figure 4:
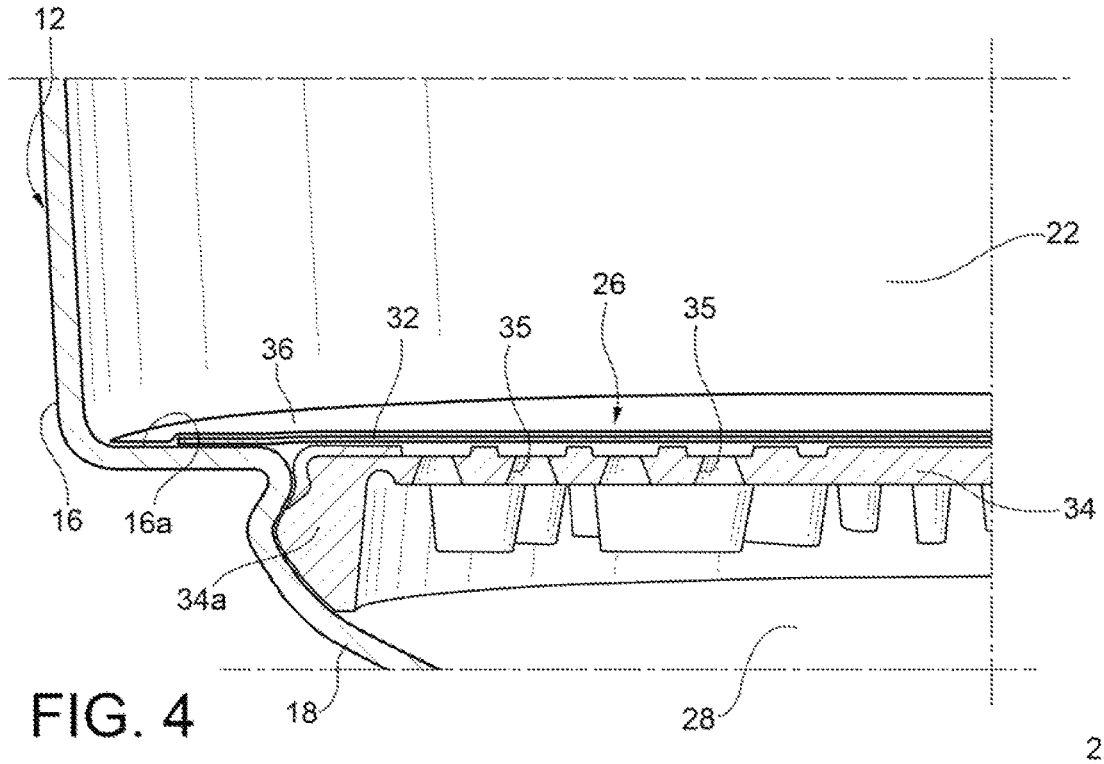
FIG. 4 and FIG. 5 are axial sectional views showing in detail a portion of the lower area of a capsule for infusion products according to a further embodiment of the present invention, respectively with the retaining wall in the initial undeformed condition and with the retaining wall in the deformed condition as a result of the introduction of pressurized hot water inside the capsule and the consequent increase in pressure inside the capsule.
Figure 5:
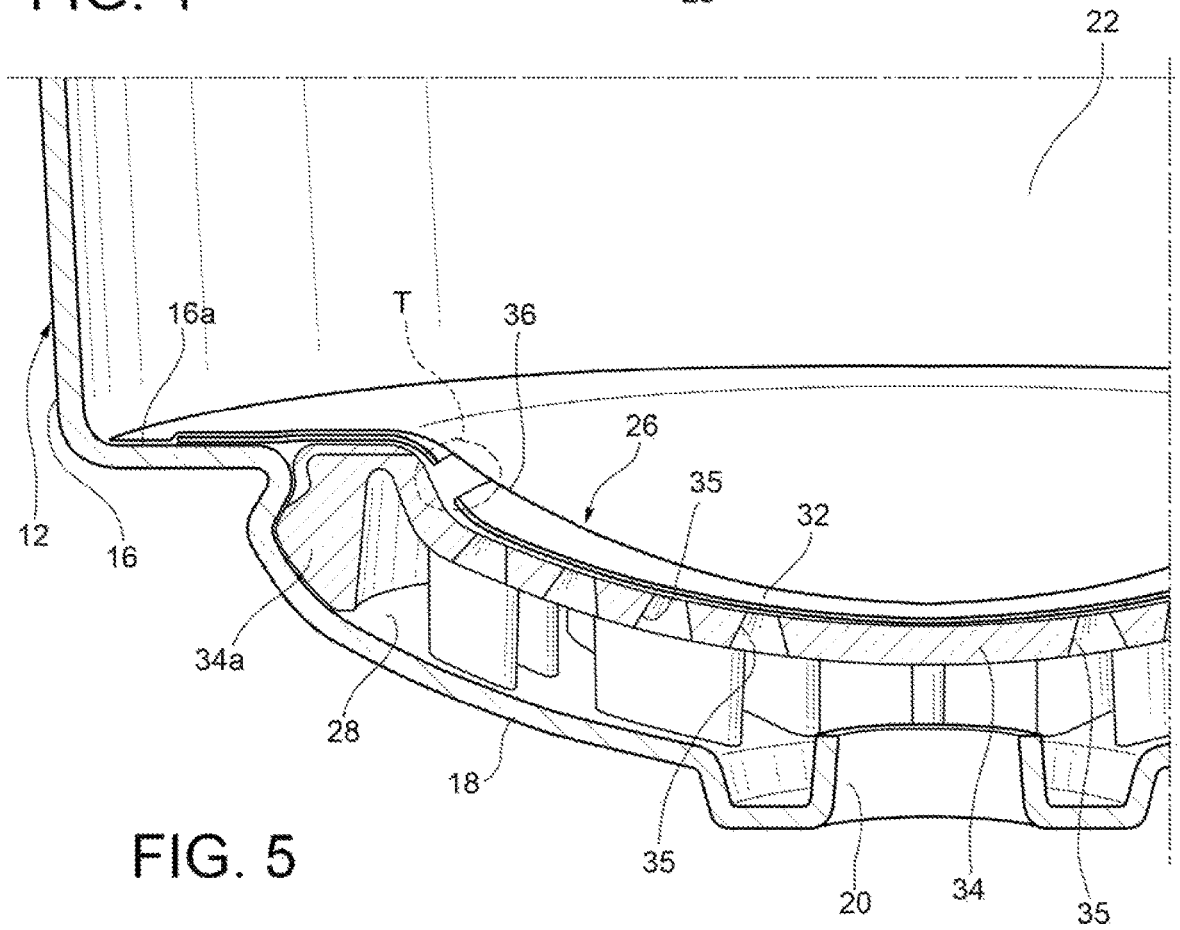

FIGS. 4 and 5, wherein parts and elements of the capsule that are identical or corresponding to those of the capsule according to the preceding Figures have been given the same reference numbers, show a further embodiment of the capsule according to the invention. According to this embodiment, the support disc 34 rests with its peripheral edge 34*a* on the bottom wall 18 of the capsule. Moreover, the impermeable layer 32, preferably formed by an aluminum film, is arranged in contact with the upper face of the support disc 34 and is firmly secured, for example by welding, to the shoulder 16*a* of the side wall 16 of the cup-shaped body 12. The filter element 36, preferably formed by a layer of filter paper, is arranged above the impermeable layer 32. An additional filter element (not shown) may also be arranged below the impermeable layer 32 and welded to the upper face of the support disc 34. FIG. 4 shows the support disc 34 and the retaining wall 26 in the initial undeformed condition, before the introduction of pressurized hot water into the capsule, while FIG. 5 shows the support disc 34 and the retaining wall 26 in the deformed condition following the introduction of pressurized hot water into the capsule. As shown in FIG. 5, as a result of the stress state in the impermeable layer 32 due to the deformation of this layer caused by the pressure increase in the capsule, the impermeable layer 32 tears in an area (indicated T) next to the peripheral edge 34*a* of the support disc 34.

Figure 6:
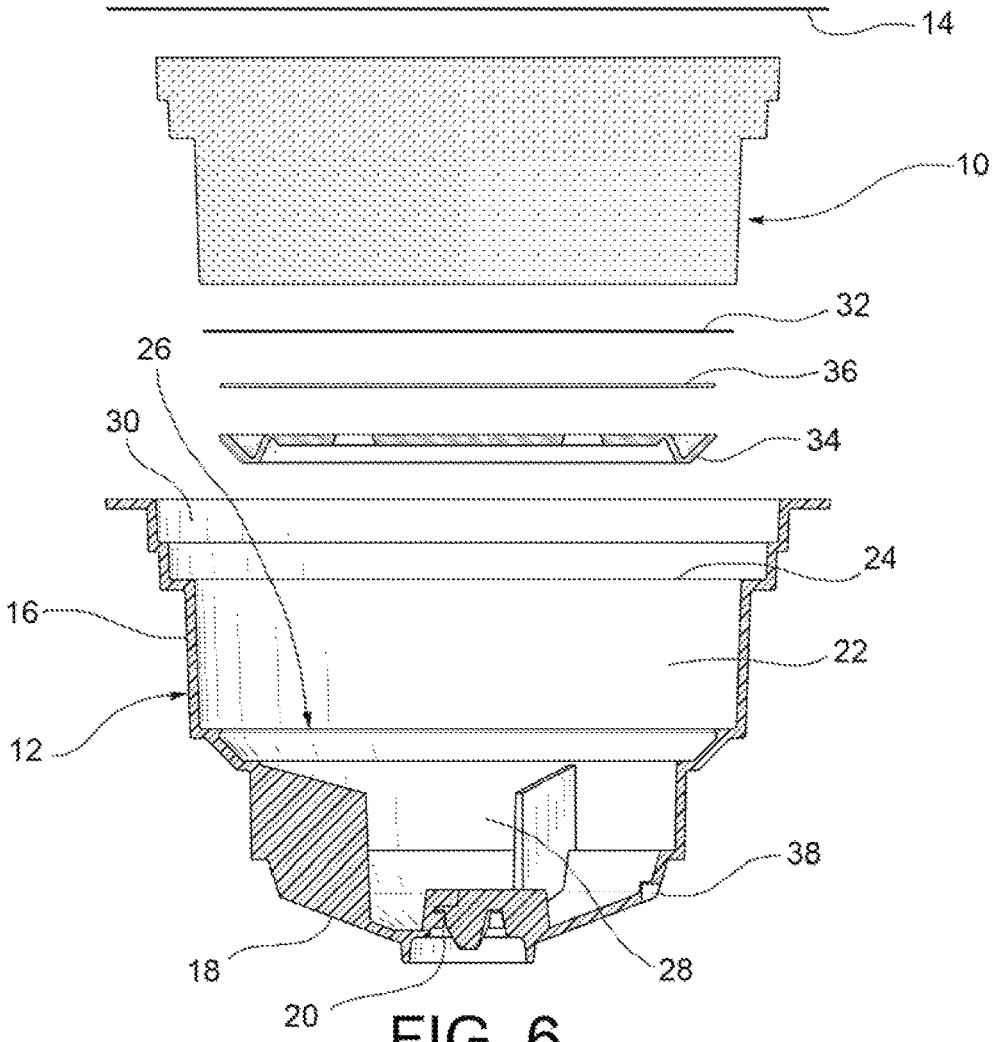
FIG. 6 shows a front exploded view of a further embodiment of the capsule.
Figure 7:
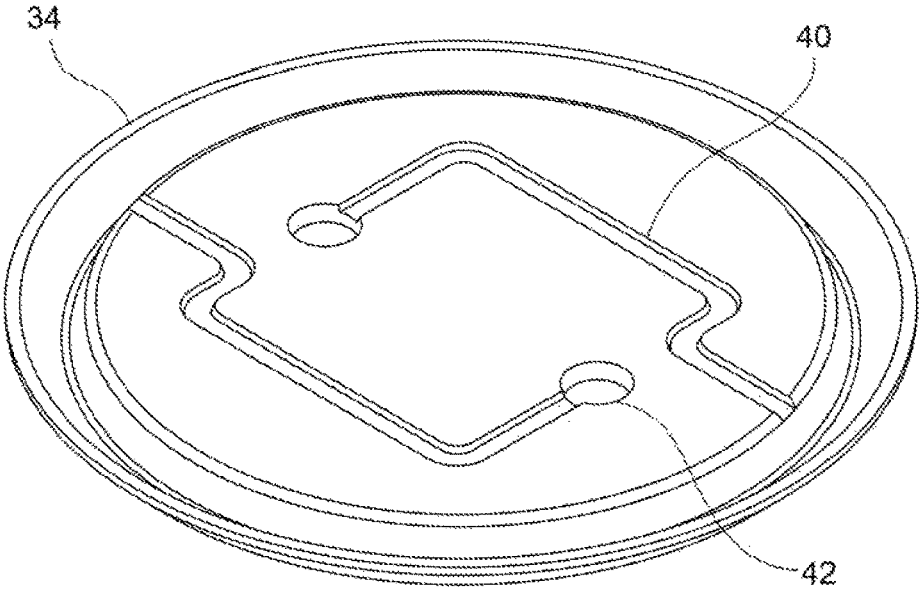
FIG. 7 shows, on an enlarged scale, the support disc of the capsule of FIG. 6.

A further embodiment of the capsule is finally shown in FIGS. 6 and 7, where parts and elements identical or corresponding to those of the capsule shown in FIGS. 1 to 3 have been given the same reference numbers. This further embodiment of the capsule differs from that of FIGS. 1 to 3 substantially in that the support disc 34 has on its upper face one or more labyrinth grooves 40 (in the illustrated example, two grooves) each ending with a respective hole 42. Due to the presence of the labyrinth groove(s) 40, the infusion that flows out of the ingredient compartment 22 undergoes a greater effect of friction before it is dispensed from the capsule, which is preferable for certain types of beverages. Apart from that, what has been said previously with reference to the embodiment of FIGS. 1 to 3 also applies to this further embodiment.

The operation of the capsule 10 described above is as follows.

Pressurized hot water is introduced into the capsule 10 by means of a needle of the machine, after puncturing the lid 14. The water thus introduced into the capsule 10 passes through the upper wall 24, if present, of the ingredient compartment 22 and thus enters within such compartment, where it is mixed with the infusion product contained therein. The increase in pressure in the ingredient compartment 22 due to the introduction of pressurized water causes the retaining wall 26 to flex downwards, i.e. towards the bottom wall 18 (see FIG. 5), until the impermeable layer 32 is torn. As previously mentioned, due to the fact that the support disc 34 follows the deformation of the impermeable layer 22, in that it deforms together with the support disc 34, the tearing of the impermeable layer 22 takes place in an area T next to the peripheral edge 34*a* of the support disc 34, rather than in a central area of this layer. The tearing of the impermeable layer 22 allows the beverage to flow out of the ingredient compartment 22 towards the lower compartment 28, and from here to flow out of the capsule through the outlet opening 20. The tearing of the impermeable layer 32 takes place in an autonomous way, solely as a result of the increase in the stress state due to the deformation caused by the pressure increase inside the ingredient compartment 22, with no need to provide, below the impermeable layer 32, perforating elements adapted to interact with such layer.

Due to the fact that the tearing of the impermeable layer 22 takes place without interaction with perforating elements, the filter element 36 remains intact, i.e. it does not tear, and therefore it is able to fully perform its filtering action, for the entire duration of the preparation process of the beverage, even in the case of an infusion product having a very fine grind, whereby the quality of the beverage obtained is significantly improved.

The principle of the invention remaining unchanged, embodiments and constructional details may be modified with respect to those described herein purely by way of non-limiting examples, without thereby departing from the scope of protection as described and claimed herein.

The invention claimed is:

1. A capsule for infusion products comprising a cup-shaped body and a lid for closing the cup-shaped body superiorly, wherein the cup-shaped body comprises a side wall and a bottom wall having at least one outlet opening for the infusion to flow out of the capsule, and a retaining wall defining inferiorly an intermediate compartment containing the infusion product, the retaining wall comprising an impermeable layer, which is firmly secured at a peripheral edge thereof to the cup-shaped body and which is configured to tear as a result of the increase in pressure in the intermediate compartment following the introduction of pressurized hot water into the capsule, and also being spaced from the bottom wall so as to define with the latter a lower compartment, wherein the capsule further comprises filtering elements configured to filter the infusion upstream of the outlet opening, and wherein the capsule further comprises a perforated and elastically deformable support disc which is arranged beneath the impermeable layer, with a peripheral edge thereof resting on the bottom wall of the capsule or on a support surface placed at a distance from the bottom wall of the capsule, and the perforated and elastically deformable support disc is configured to deform towards the bottom wall of the capsule, as a result of a deformation of the impermeable layer when the pressure inside the intermediate compartment increases due to the introduction of pressurized hot water into the capsule, until the impermeable layer tears as a result of the deformation of the impermeable layer.

2. The capsule of claim 1, wherein the impermeable layer comprises aluminum or plastic material.

3. The capsule of claim 1, wherein the impermeable layer has at least one tear point configured to tear at said at least one tear point.

4. The capsule of claim 1, wherein the support disc comprises a plurality of holes distributed over the entire support disc or over at least a part of it.

5. The capsule of claim 1, wherein the support disc comprises, on its upper face, at least one labyrinth groove ending with a hole.

6. The capsule of claim 1, wherein said filtering elements are placed above and/or below the impermeable layer.

7. The capsule of claim 1, wherein said filtering elements are placed between the impermeable layer and the support disc or below the support disc.

8. The capsule of claim 6, wherein said filtering elements are firmly connected to the support disc.

9. The capsule of claim 1, wherein said filtering elements comprise a layer of filter paper.

10. The capsule of claim 1, wherein the support disc comprises plastic material or filter paper.

11. The capsule of claim 1, wherein the lid is impermeable.

12. The capsule of claim 11, further comprising an upper wall superiorly defining the intermediate compartment, the upper wall comprising a plurality of holes and being spaced from the lid so as to define an upper compartment.

13. The capsule of claim 12, wherein the upper wall comprises a microperforated film.

14. The capsule of claim 1, wherein the lid is permeable.

15. The capsule of claim 1, wherein the cup-shaped body comprises in its lower area, in addition to said at least one outlet opening, a lateral hole adapted to put the lower compartment of the capsule in communication with an external environment in order to maintain the pressure in the lower compartment equal to an external pressure.

* * * * *